US005211506A

United States Patent [19]

Manion

[11] Patent Number: 5,211,506

[45] Date of Patent: May 18, 1993

[54] BACKER ROD OR BOND BREAKER CORRECTIVE PLACEMENT TOOLS

[76] Inventor: William Manion, P.O. Box 1776, Slidell, La. 70459

[21] Appl. No.: 684,652

[22] Filed: Apr. 12, 1991

Related U.S. Application Data

[63] Continuation-in-part of Ser. No. 596,095, Oct. 11, 1990.

[51] Int. Cl.[5] ..... E01C 23/09

[52] U.S. Cl. ..... 404/87; 52/DIG. 1

[58] Field of Search ..... 404/87, 74, 69, 107; 52/743, 749, DIG. 1, 127.5; 29/235, 451, 460; 277/9, 10, 11, 12

[56] References Cited

U.S. PATENT DOCUMENTS

| | | | |
|---|---|---|---|
| 2,068,035 | 1/1937 | Meyer | 277/11 |
| 2,719,341 | 10/1955 | Clerk | 52/DIG. 1 |
| 2,761,199 | 9/1956 | Allen | 29/235 |
| 3,395,627 | 8/1968 | Barton | 404/87 |
| 3,488,828 | 1/1970 | Gallagher | 52/DIG. 1 |
| 3,550,242 | 12/1970 | Sarvay et al. | 29/235 |
| 4,341,007 | 7/1982 | Kruszona | 404/87 |
| 4,738,562 | 4/1988 | Howsley | 404/87 |
| 4,765,771 | 8/1988 | Howsley | 404/87 |

FOREIGN PATENT DOCUMENTS

| | | | |
|---|---|---|---|
| 1087338 | 8/1960 | Fed. Rep. of Germany | 404/87 |

*Primary Examiner*—William P. Neuder

*Attorney, Agent, or Firm*—Alexander Norcross

[57] ABSTRACT

Tools for correcting placement of backer rod on tape within the spacings between adjacent stones of a building assures proper depth of sealing compound for setting of protective caps and for preventing pulling or separation of the sealing material due to subsequent joint dimensional movement. The tools are based on a flat plate, having an edge of a thickness adapted to a substantial proportion of the width of the joint to be sealed. Along one or both sides of the plate, parallel to the edge, are gauging bars, spaced a distance from the edge proportional to the joint width of the joint for optimum sealing depth. The edge placement tool has an open channel as its operative edge, and in use is tamped along the joint down on backer rod, correcting the placement where the backer rod edges contact the joint walls without displacing the body of the backer rod. The facing tool has an operative edge in the form of a preferred concave cylindrical curve which is slid along the emplaced backer rod forming a proper rod curvature for establishing an optimum sealant rear shape.

8 Claims, 5 Drawing Sheets

WEATHERCAP Anchorage Relation to Backer Rod

| Type | Width of Joint | | Depth of Joint to Backer Rod | |
|---|---|---|---|---|
| | Inches | mm | Inches | mm |
| A-2 | 3/8 | 9.525 | 9/16 | 14.288 |
| A-3 | 7/16 | 11.113 | 5/8 | 15.875 |
| A-4 | 3/4 | 19.050 | 11/16 | 17.463 |
| A-6 | 1 1/4 | 31.750 | 3/4 | 19.050 |
| A-8 | 1 1/2 | 38.100 | 1 1/8 | 28.575 |
| A-12 | 2 1/2 | 63.500 | 1 1/4 | 31.750 |
| A-16 | 3 | 76.200 | 2 | 50.800 |
| B-2 | 5/16 | 7.938 | 9/16 | 14.288 |
| B-3 | 1/2 | 12.700 | 5/8 | 15.875 |
| B-4 | 5/8 | 15.875 | 11/16 | 17.463 |
| B-6 | 3/4 | 19.050 | 11/16 | 17.463 |
| B-8 | 1 1/4 | 31.750 | 1 1/8 | 28.575 |
| B-10 | 1 1/2 | 38.100 | 1 5/8 | 41.275 |
| B-16 | 2 5/16 | 58.738 | 2 | 50.800 |
| B-17 | 3 | 76.200 | 2 3/8 | 60.325 |
| B-18 | 3 1/4 | 82.550 | 2 1/2 | 63.500 |
| B-19 | 3 3/4 | 95.250 | 3 | 76.200 |

FIG. 9

BACKER ROD OR BOND BREAKER CORRECTIVE PLACEMENT TOOLS

RELATED APPLICATIONS

This application is a continuation-in-part of my copending application 07/596,095 filed Oct. 11, 1990.

BACKGROUND OF THE INVENTION

It has long been known in the building art that stonework, for example coping, reglets, balustrades or belt courses, must have sealed joints between adjacent stones, and between stones and adjacent masonry. Buildings move, and stonework, being used to finish or delimit the periphery of building structures, is usually at the point of maximum movement. Failure of the joint, with consequent degradation of the masonry and building structure from water intrusion, is a major construction problem.

Current practice in the art is to clean and fill the joint with a caulk or sealant, usually a structural sealants such as are manufactured by the General Electric Company, Dow Corning, Pecora and others. So long as the sealant bonds to the stone work, and is itself protected from environmental damage, the joint seal will remain good.

Addressing coping as an example, protection of the sealant may be accomplished by capping the sealant with a protective outer strip, such as Weathercap, a trade marked lead protective joint covering. This joint cover must be embedded in the basic joint sealant.

In order to properly bond the joint, and afford any protective cover, the joint sealant must be placed within the joint to a depth which is a function of the joint width. The joint itself may be of greater depth, and may have effectively infinite depth, as in parapets and reglets, due to a relatively large open area behind the joint. The joint integrity requires bonding of sealant to the stone and protective strip, by restraining injection of sealant with backer rod or bond breaker tape emplaced in the joint.

Backer rod is a continuous foam, expanded in shape, either of open or closed cell composition, which is compressed in place between stones to limit depth of sealant and to serve as a post dam. Use and selection of an appropriate backer rod or bond breaker tape is specified by the manufacture's instructions for the chosen breaker rod or bond breaker tape.

Proper standards for a joint seal are called forth in ASTM Standard Guide C 962-86, published September 1986, on the use of Elastomeric Joint Sealants.

SUMMARY OF THE INVENTION

This invention relates to the sealing of joints within stonework in building. The integrity of the joint seal in stonework, especially where a cap is inserted within the sealing material to protect the seal, is enhanced by providing a spacing tool which sets an optimum, uniform depth into the joint of the backer rod, thus establishing a known minimum sealant depth.

In my co-pending prior application, I disclose a tool, preferably in the form of a flat paddle, having a elongate straight outer edge face which is shaped to a width slightly less than the width of the joint to be sealed. The straight edge serves to set the backer rod, but the edge width serves as a gauge, sizing the tool to the joint, and insuring the appropriate tool is used for a given joint by preventing insertion of overlarge tool widths, and by feel of excessive play, indicating the use of too small a tool.

I have discovered two additional tools that may be advantageously employed to more correctly set backer rod or bond breaker tape in joints which, by reason of the character of the stone, wear, weathering or damage, resist or catch and drag backer rod as backer rod is inserted into the joint. Such actions prevent the backer rod from being set to the best depth, or interfere with the formation of a proper sealant bond between the adjoining stones.

The first tool is an edge setting tool. It is observed that defective stonework may catch the edges of backer rod, preventing full insertion into the stonework joint; this shows as an irregular appearance of a concave surface on the backer rod. Where such occurs, insufficient bonding depth exists for the sealant, and the resulting joint is weak and will tear.

My edge setting tool therefore has two parallel, equally extending plates or blades, gauged to the width of the joint being set. These plates, when the tool is tamped into the joint, push the edges of the backer rod free, and to the proper depth, without significantly altering the placement of the body of the backer rod. The tool clears a sufficient depth of stonework in the joint between the backer rod and the surface of the stones, to provide for adequate sealing contact and adhesion.

Even with proper initial adhesion, the shaping of the rear of the sealant has a marked effect on the lifetime reliability of the seal. Unless the rear seal geometry is properly a concave curve, corresponding to a proper convex curvature of the backer rod, movement of the joint, through expansion and contraction of the stonework, will eventually tear the adhesive seal of sealant to stone, and the joint will fail.

My second tool therefore is provided with a concave face having the proper shape for the rear of the sealant in the joint, and serves to reshape backer rod which may have been deformed by catching, gripping or tearing on poor stonework, and provides a final shaping, after edge resetting, to the most desirable form for the joint sealant.

On at least one side of each of the new tools, parallel to the edge, and spaced from the edge a distance representing the optimum backer rod depth for a given joint width corresponding to the width of the edge, is a gauging bar, preferably in the from of a square cross section, presenting a flat face to ride along the face of the stones being sealed.

In use, a length of backer rod is inserted in the joint, by means of the tool of my co-pending application. If the backer rod adheres or is caught on the stonework, the new tool is inserted until the gauging bar rides on the face of the stone, and the tool is then tamped in such manner along the joint, setting the edges of the backer rod. The self-gauging properties of the tool insure that the backer rod edges are set at the optimum depth for the joint seal.

After the backer rod edges has been reset by the first tool, the second tool is then inserted and slid along the backer rod, reshaping the surface of the backer rod into the best shape for sealant insertion. If recommended by the sealant manufacturer, a priming coat may be applied to the stonework, and Sealant is then injected, filling the gap against the backer rod in full contact with the sides of the stonework joint. The Sealant may then be tooled to provide a concave outer surface or, optionally, a protective cap may be set in the sealant.

The use of the new tools corrects any problems in properly setting backer rod into a stonework joint, especially a reworked or damaged joint, and insure that, along the entire joint, an optimum depth of sealant has been set for best joint integrity, that no shallow spots lack sealant, and no over deep spots have allowed sealant to run off without being pressure bonded to the joint walls.

It is thus an object of the invention to disclose tools which insure optimum joint sealing in damaged or rough stonework joints.

It is a further object of the invention to show tools which self gauges the appropriate setting depth for backer rod.

It is a further object of the invention to show tools which establishes an optimum stone work joint seal by proper positioning of a backer rod with respect to the joint and the sealant.

It is a further object of the invention to show tools which significantly reduce failures of stone work joint seals by proper positioning of a backer rod behind the sealant.

It is a further object of the invention to show tools which significantly reduce failures of stone work joint seals by setting the appropriate sealing depth and geometry for a given joint width.

BRIEF DESCRIPTION OF THE DRAWINGS

FIG. 9 is a table of recommended sealant depths versus joint widths for one joint protective strip.

DETAILED DESCRIPTION OF THE PREFERRED EMBODIMENT

Figure 1:
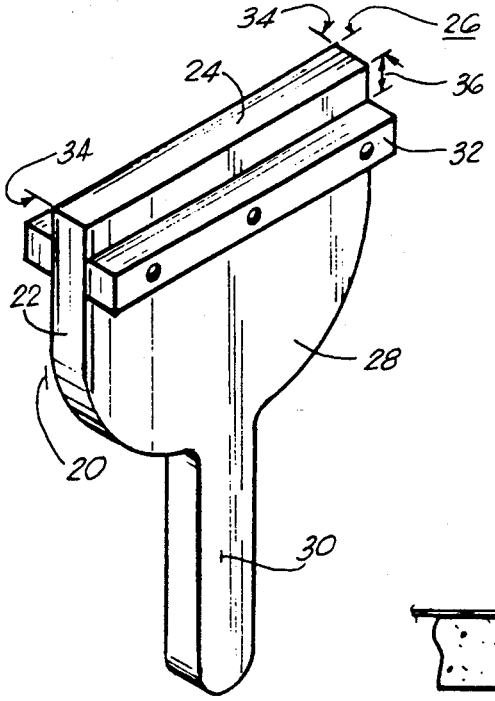
FIG. 1 is an oblique view of one embodiment of the tool of my co-pending application.
Figure 2:
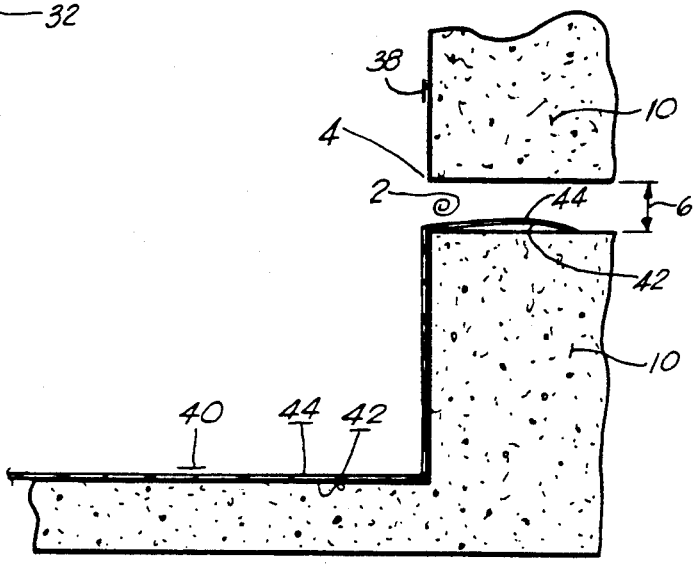
FIG. 2 is a side sectional view of a reglet joint with flashing.
Figure 3:
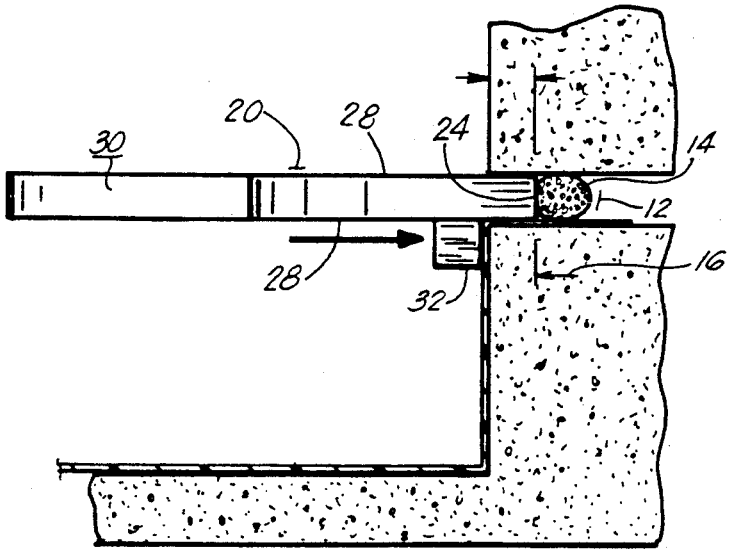
FIG. 3 is a side sectional view of a reglet joint with flashing, placing backer rod with the tool of my co-pending application to a depth.
Figure 4:
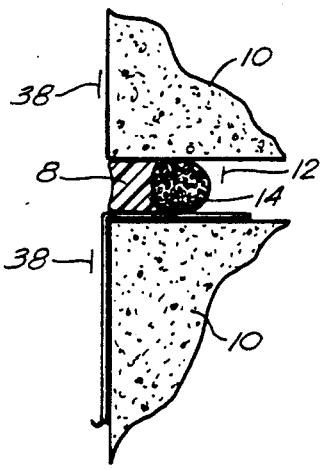
FIG. 4 is a side sectional view of a reglet joint with flashing, showing the sealant .
Figure 5:
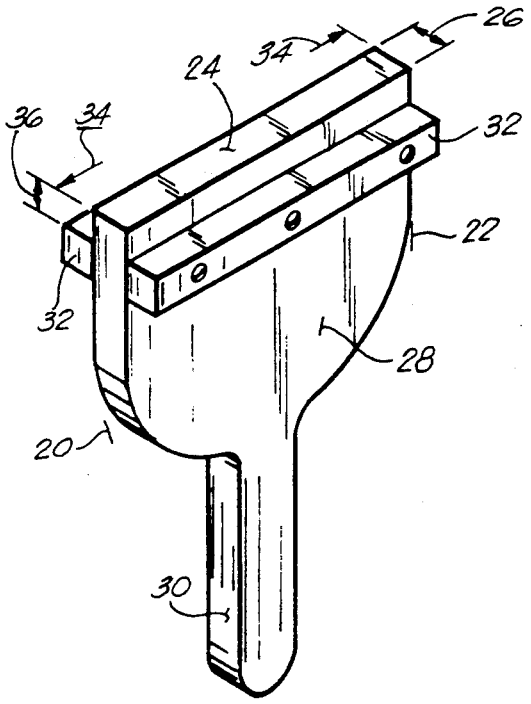
FIG. 5 is an oblique view of a second embodiment of the tool of my co-pending application.
Figure 7:
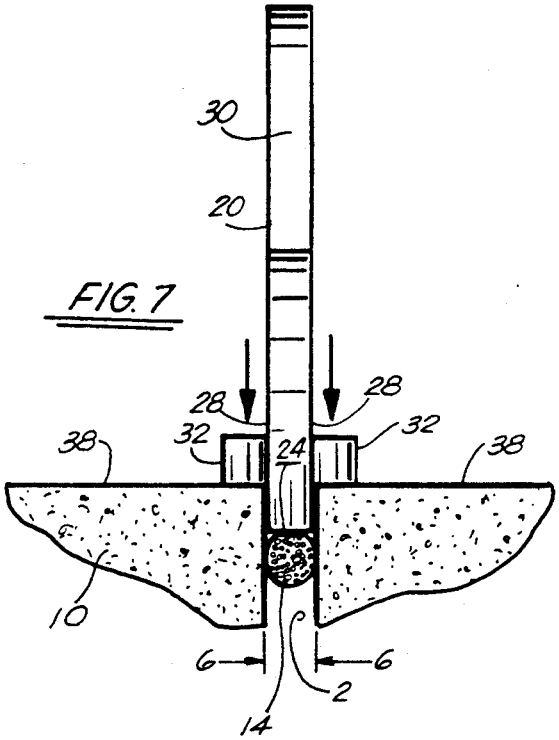
FIG. 7 is a top sectional view of a joint, placing backer rod with the tool of my co-pending application to a depth.
Figure 6:
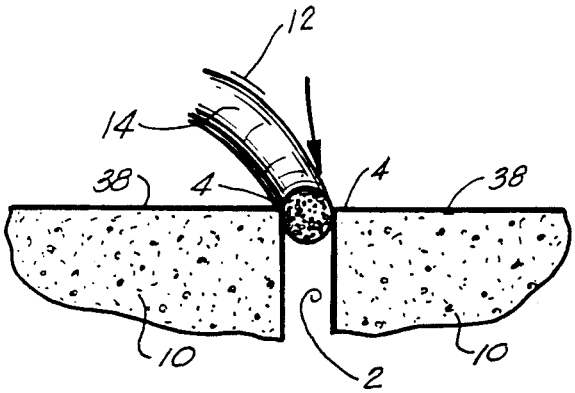
FIG. 6 is a top sectional view of a stonework joint showing manual insertion of backer rod.
Figure 8:
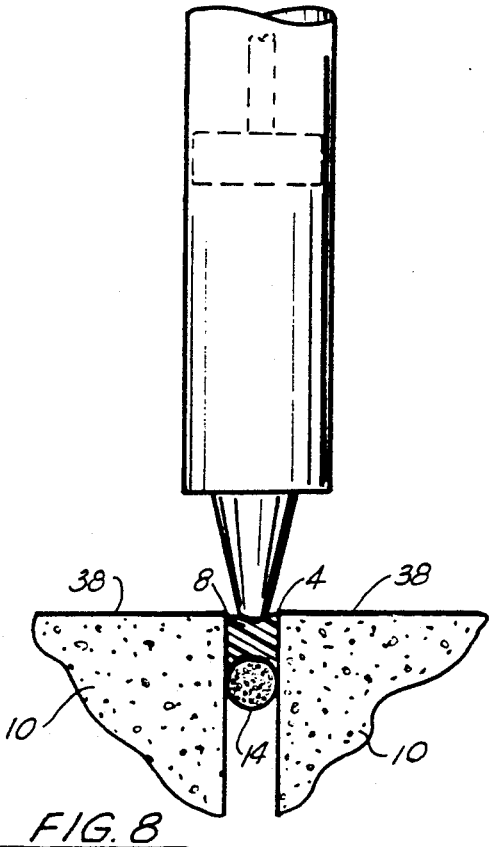
FIG. 8 is a top sectional view of a joint, showing sealant.

This invention relates to the field of stonework, and to the sealing of joints between stonework. Stonework, which is most often used in building as the parapet or as a cap or transition in walls, as with coping, reglets, balustrades or belt courses, must adapt to motion of the building, and the inevitable relative motions between stones resulting from thermal expansion and contraction. Therefore, unlike masonry, which is often joined by rigid mortars, Stonework joints must retain their integrity even though the joint moves.

For this reason, stonework joints are filled with adhesive sealers which must retain adhesion and some resiliency through time. The most common current sealers are silicone based structural sealants and caulks. There are a myriad of manufacturers and types; examples include General Electric Silpruf NP TM, a typical silicone sealant; Pecora's Dynatrol TM Urethane sealants, and Woodmont's Chem Calk TM series of silicone, urethane or Oleoresinous sealants. Any such sealants, to be effective, must bond to the stone sides of the joint. This requires that the joint be clean, dry , and free of dust or loose mortar or old sealant. Further, as the sealant sets up, the resulting chemical reaction may release water vapor, or climatic conditions may cause water vapor to be present. This vapor must be free to escape, or the formed joint seal may become defective.

It is also desirable to protect the resulting seal from long term degradation by providing an external cap, such a Weathercap TM lead strip, which is itself embedded in the sealant. This last strip is not shown in the drawings for clarity, but is shown and described in U.S. Pat. No. 2,016,968, which is incorporated herein by reference in full.

Although the drawings illustrate a square ( straight sided ) joint 2 for illustration, repaired joints 2 often are beveled at the entrance 4 to the joint 2 by the action of cleaning and routing out old mortar, sealant and debris. In order for the sealant 8 to be resistant to mechanical tearing from motion of the joint, it is important that the sealant 8 extend down into the joint 2 into a straight sided section 9; if the sealant 8 is restricted to the beveled entrance 4, the expansion forces will be too great for the sealing bond to withstand and the sealant bond to the stone 10 will ultimately fail, permitting leakage.

Thus the sealant 8 must be injected into the joint 2 for a suitable depth 16, and yet some side pressure to force sealant 8 against stone 10 for bonding must occur. This effect is produced by providing a backing 12 in the joint 2, forming a closed space into which the sealant 8 may be injected, and restricting the flow of the sealant 8 into the joint width 6 so as to provide positive contact and bonding to the stones 10. This backing is provided by inserting an adhesive tape backing, called a bond breaker tape (not shown), or by insertion of a continuous length of foam rope, called backer rod 14.

The sealant 8 should not be fixed to a rigid backing, or all forces of stone expansion and movement will be concentrated, causing tearing and failure of the joint. The preferred back shape of the sealant is a concave curve (with respect to the sealant) and thus the most common backing, backer rod 14, is convex in surface shape 64 so as to impart the proper rear shape to the sealant 8. The term "bond breaker" tape refers to this requirement that the rear of the sealant not be bonded to a rigid structure, but be free to deform to relieve stresses in the sealant caused by stone movement.

Throughout this discussion backer rod 14 will be used as an exemplar; however it will be understood that the tools of the invention and the discussion apply equally to bond breaker tape.

The backer rod 14 deforms to fit within the joint width 6, yet provides, through expansion and friction against stones 10, resistance to motion under sealant pressure. If the stone 10 is porous, as with limestone or sandstone, a closed cell backer rod 14 is generally recommended. If the stone 10 is impermeable, then an open cell foam backer rod 14 is generally recommended, to permit water vapor to escape more freely as the sealant 8 sets up, reducing the incidence of sealant 8 bonding failures.

None the less, sealing failures in stonework joints 2 still occur, evidenced usually by water leakage into the structure of the building. Because of the location of the stonework in a masonry wall, such leakage usually contributes to significant structural damage by the time it is localized and stopped.

It is a discovery of the inventor that this incidence of failure may often be attributed to the lack of control of the depth 16 of the sealant 8 injected into a joint 2, and the failure of the sealing personnel to adapt and control this depth 16 based on the joint width 6, providing sufficient sealant 8 to bond below any beveled entrance 4 of the joint 2, and sufficient sealant 8 to enclose any protective cap.

In my co-pending application Ser. No. 07/569,095, which is incorporated herein by reference, I disclose as my invention a tool 20 that self gauges the joint width 6, and for each such joint width 6, sets an appropriate depth 16 for backer rod 14 or bond breaker tape, and then may be manually manipulated to fit the backer rod 14 or bond breaker tape into the joint 2 at the preferred depth 16. The resulting sealed joint 2, having been set to a preferred uniform, adequate depth 16, has a significantly reduced incidence of failure.

Figure 10:
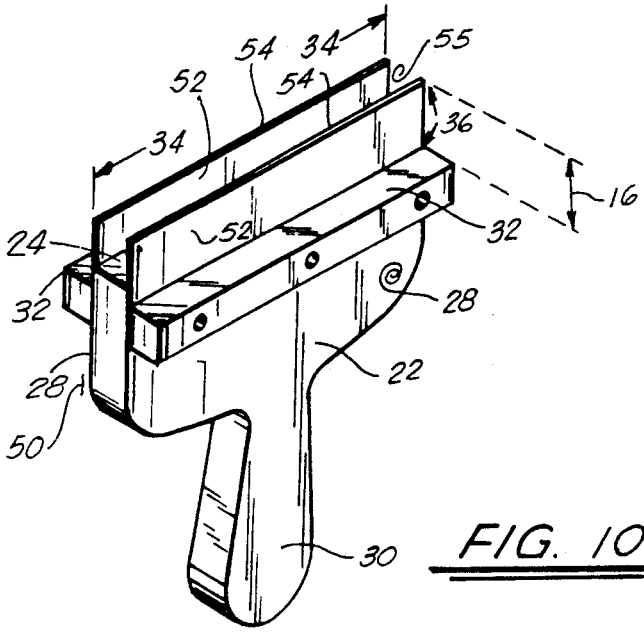
FIG. 10 is a view of the edge placement tool of my invention.
Figure 11:
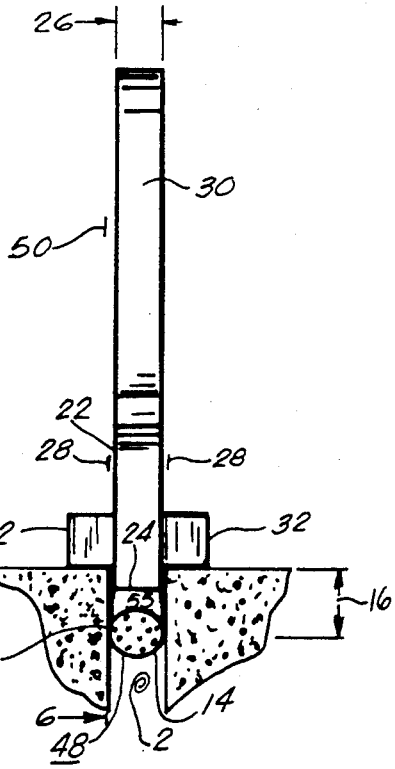
FIG. 11 is a view of the edge placement tool of my invention in use.
Figure 12:
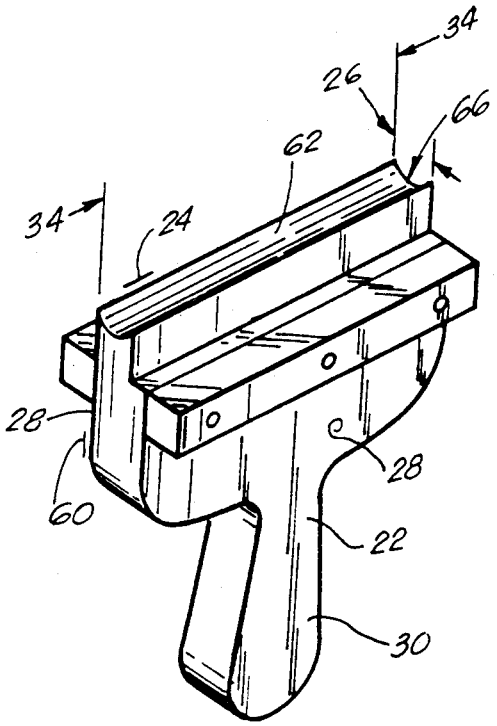
FIG. 12 is a view of the bead shaping tool of my invention.
Figure 13:
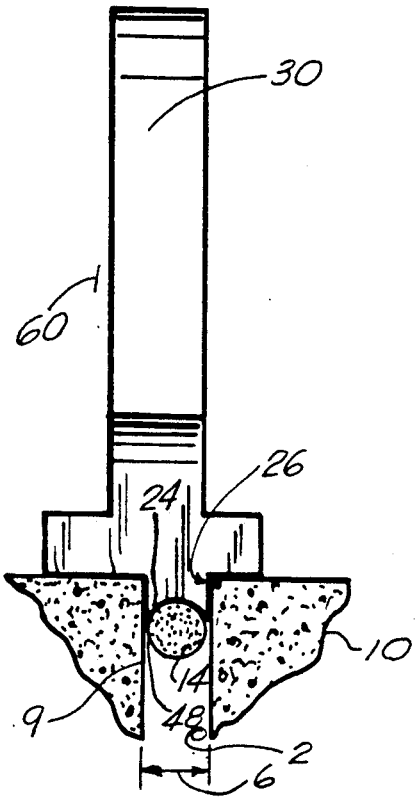
FIG. 13 is a view of the bead shaping tool of my invention in use.
Figure 14:
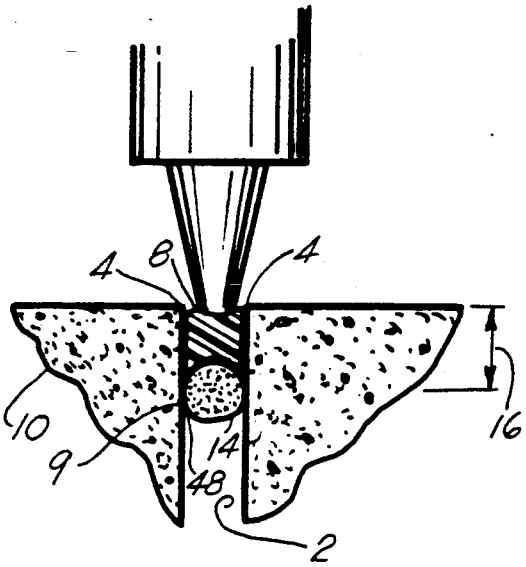
FIG. 14 is a view of the insertion of elastomeric sealant into a gap having a properly placed backer rod.
Figure 15:
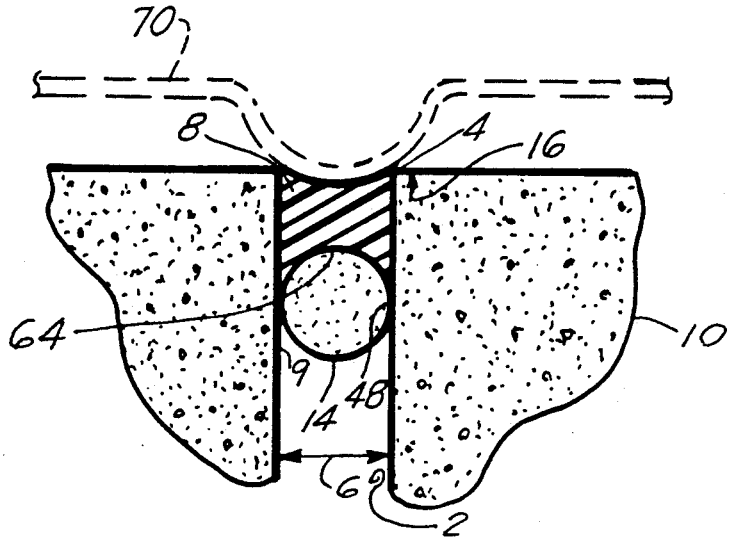
FIG. 15 is a view of the prior art tooling as discussed in ASTM Guide C 962-86.

Referring to FIGS. 10 and 12, I show a form of backer rod edge placement tool 50 and a form of backer rod bead shaping tool 60.

Both edge placement tool 50 and bead shaping tool 60 are, in basic form, a thick paddle 22, having a rectangular facing edge base 24, whose width 26 is the thickness of the paddle 22 between sides 28. A handle 30 is mounted on the paddle 22 opposite the facing edge 24 to facilitate usage of the tools 50,60.

Referring to the edge placement tool 50, I disclose a substantial handle 30 attached to paddle 22 having a uniform thickness 26, adapted to the width of the gap or joint 2 between stones within which backer rod 14 and sealant 8 is to be placed. Parallel to the facing edge base 24, and off set from the operative edges 54 of the edge placement tool 50 a distance equal to the desired sealant adhesion depth 16 for the gap 2, I provide at least one and preferably two depth gauging bars 32, running parallel to the facing edge base 24 and extending outward from the facing edge base 24.

Gauging bar 32 runs parallel to the placement edge 54, and extends the length 34 of the placement edge 54. The distance 36 between the bar and the placement edge 54 is the preferred sealant depth 16 along the sides of a joint 2 whose joint width 6 is gauged by the thickness 26 of the paddle 22. Thus a plurality of such edge placement tools 50, having varying paddle thicknesses 26 and edge distances 36 may be provided, each such tool being appropriate for a particular joint width 6. The gauging thickness 26 need not be exact, as the recommended sealant depth 16 is valid for a range of joint widths. The tool thickness 26, which is the distance between edge engaging plates 52, is therefore selected to match the narrowest joint width 6 of that range, so that it acts as a gauge to insure the appropriate sealant depth 16 is set for that range of joint widths 6.

The paddle 22 is of a uniform thickness, equal to the gauging width 26 of the edge 24. Reworked joints 2 become beveled at their entrance 4 through the action of cleaning tools, chipping and weathering. As a result, a measurement of joint width 6 at the surface 38 of the stone 10 will be inaccurate; the joint width 6 for sealing is measured between straight walled sections 9 deeper in the joint 2. Thus the basic paddle structure disclosed for tools 50,60, as well as my prior disclosed tool 20, provides a gauge which uniformly gauges joint width 6 down in the joint 2 at the preferred sealing depth 16.

Extending from the sides of the paddle 22 beyond base edge 24 are two parallel thin metal backer rod edge engaging plates 52, forming therebetween an open channel section 55. The plates 52 terminate in parallel flat operative edges 54 of a length substantially equivalent to the length 34 of the base 24 of the placement tool 50.

In use it has been found that when replacing backer rod 14 within gaps 2 within existing stonework, that the existing stonework, due to the effects of leakage, weather and failure of the previous seals, develops a rough, scalloped appearance having internal projections, cracks and protrusions even after cleaning of the gap 2. Further, the act of mechanically cleaning the gap 2 of old failed sealer tends to further round and crack the edges of the gap 2.

Under these circumstances, the backer rod 14, when placed with the tool 20 of my prior pending application, may tend to adhere or catch on the protrusions within the side walls 9 of the joint 2, forming an inverted concave appearance when placed to depth. This is especially true during the use of porous foam backer rods 14 of the type specified for relatively impermeable stone work.

This form of concave surface formed in backer rod 14 is undesirable. It has been found that sealant 8 placed on a concave backer rod 14 is not placed to an adequate depth of stonework inasmuch as such concave edges of the backer rod 14 extend outwardly in the joint 2 separating sealant 8 and stone.

Therefore, upon visual detection of a concavity in the surface of the backer rod 14, the backer rod edge placement tool 50 is passed down into the stone joint 2 in a tamping motion along the joint 2. The edge engaging plates 52, being spaced by the paddle thickness 26, are substantially parallel to and in contact with the side walls of the joint 2, and contact the edges 48 of the backer rod 14 only where they are contiguous with the stonework, forcing these edges 48 down along the stonework into the joint 2, but without moving the body of the backer rod 14 from the position established by the initial gauging bar 32 of the rod placement tool 20. The gauging bars 32 upon the backer rod edge placement tool 50 properly gauge the depth of insertion 16 of the edge plates 52 so as to place the edges 48 of contact of the backer rod 14 with the stone work at an appropriate depth 16, as specified by the sealant manufacturer for desirable sealing.

This corrective placement may be judged by the restoration the convex surface 64 found most desirable for backer rod 14 backed seals within stonework gaps or joints 2.

It has been found further desirable, where there is significant resistance to insertion of the backer rod 14 into the stonework joint 2, as in stones that have suffered significant environmental or weathering damage or are particularly rough and coarse, to provide a backer rod bead shaping tool 60. This tool is in form similar to that of the backer rod placement tool 20 of my prior pending application, save in that the backer rod placement face 24 of the tool 60 is formed as a round cylindrical concave surface or channel 62 having a radius or diameter 62 substantially equal to that of the backer rod of a size known to be appropriate to a stonework joint gap width 6 for which the gauging width 26 of the tool 60 is designed.

This tool 60 is used by tamping and sliding to further restore the proper convex shape of backer rod 14 which has been place by the tool 20 of my prior pending application. It is of especial utility where there is significant adhesion or catching of the backer rod 14 on the stonework, as shown by visual inspection of the placement of the rod 14 within the joint 2. This tool gauges the depth of the backer rod 14 within the stone joint 2 and is gauged itself to the width 6 of the stone joint 2; there is therefore a particular diameter backer rod 14 known to be appropriate corresponding to the thickness 26 of its base insertion member. The tool 60 extends for a significant length 34, thereby allowing it to be slid along the backer rod 14 without pulling previously placed backer rod 14 out of position as it is reshaped. The tool 60, as with the prior tool 50 shown, also provides, by the significant length 34 of gauging contact, proper placement and curvature of the backer rod 14 around complex curve surfaces in the face of the stonework.

When backer rod 14 is placed in stonework having significant resistance to backer rod placement, or significant roughness, the backer rod 14 may be first placed to proper depth by the tool 20 of my prior co-pending application.

The edges 48 of the backer rod 14 are then broken free from adherence to the roughened side walls 9 of the stonework by use of the edge placement tool 50, pushing the outer edges 48 of the backer rod 14 which are in contact with the stonework to a proper depth 16 along the stonework walls 9 of the joint 2. This establishes a proper depth 16 for sealant adhesion to the stonework.

The facing tool 60 may then be slid along the backer rod 14 restoring a proper convex surface to the backer rod 14 within the joint 2. The three tools 20,50,60 in combination form a sealant receiving joint 2 having extensive sidewall contact down to the edges 48 of the backer rod 14 and having a curved back surface, found most desirable within sealing for permitting expansion and contraction of the seal of the stonework without causing ripping, tearing or separation of the seal.

The joint 2 is then prepared for sealant by masking the stonework, and by priming the walls 9, as recommended by the manufacturer of the sealant chosen for use.

The sealant 8 is injected into the stonework joint 2, filling the joint 2 between the backer rod 14 and the stone walls 9. The surface of the sealant may then be worked with any of the prior art working tools 70 to provide a curved outer sealant surface, or then may have an impermeable metal cap inserted within the sealant 8 as shown. It is to be noted that the tooling 70 for working the surface of the sealant is adapted from those tools used for masonry or mortar finishing. These tools may, by their geometry, penetrate deeply into a wide stonework joint, and coution must be observed not to weaken the sealant by too deep a surface curvature.

It has been found that the additional tools of the invention provide for a proper setting of backer rod 14 within a work stone joint 2, especially the damaged or weathered type of joint 2 commonly encountered in reworking failed joint seals within stonework and buildings. They provide for a uniform, accurate placement and shaping of the backer rod 14 to provide the most preferred type of sealing shape and placement. It is found that by making these tools of a significant length, with respect of the width of the joint 2 to be sealed, that a more uniform placement of the gap backer rod 14 may be achieved than by periodically tamping the backer rod 14 into the joint 2 with narrow tool or rods and further, that the deleterious effects which occur from the stretching of the backer rod 14 due to repeated tamping and pulling along its length by the prior art tools is avoided.

It should be seen from the application and the description that the tools of the invention provide, in combination, for a much more reliable and repeatable seal, especially within reworked stonework or stonework of a marginal quality, than the prior art tools and methods of placing backer rods and completing a seal within stonework joints.

It can thus be seen that the invention extends to the equivalents of the embodiment described above.

I claim:

1. A tool for improved placement of a backing within a stonework joint for sealing thereof comprising:

a paddle;

an edge on said paddle having a thickness and a length;

a gauging bar, parallel to said edge;

two parallel edge engaging plates affixed to the paddle, extending beyond said gauging bar a distance, forming a channel therebetween.

2. The apparatus of claim 1 further comprising:

said distance being proportioned to said thickness.

3. The apparatus of claim 1 further comprising:

said distance being the appropriate depth for contact of sealant in a joint having a width approximately equal to the paddle thickness.

4. The apparatus of claim 1 further comprising:

said engaging plates defining backer rod engaging edges;

said engaging edges being parallel, extending a length which is longer than said thickness.

5. The apparatus of claim 1 further comprising:

said thickness being a gauge for matching a joint;

said gauging bar distance being a gauge for sealant wall contact within said.

6. A tool for correction of placement of backer into a stonework joint comprising:

means for insertion gauging a joint width of said stone work joint;

means for correcting the placement of the contact of the edges of backer within said joint;

means, proportioned to the joint width gauged by said means for insertion, for gauging the depth of said contact of the edges of backer within said joint; said means for correcting the placement of the contact comprise:

a channel having parallel sides and outer edges, extending a distance from said paddle.

7. The tool of claim 6 wherein said means for gauging depth comprise:

a gauging bar, parallel to said means for correcting the placement of the contact, and spaced a distance therefrom equal to said depth.

8. The tool of claim 6 wherein said means for gauging depth comprise:

two parallel gauging bars, each parallel to said means correcting the placement of the contact, and spaced a distance therefrom equal to said depth.

* * * * *